US005568241A

United States Patent [19]

Creutzmann et al.

[11] Patent Number: 5,568,241

[45] Date of Patent: Oct. 22, 1996

[54] THERMOFIXING DEVICE FOR A PRINTING OR COPYING MACHINES HAVING A LOW TEMPERATURE PREHEATING SADDLE

[75] Inventors: Edmund Creutzmann, Markt Schwaben; Andreas Eckardt; Joachim Hoffmann, both of München; Walter Kopp, Taufkirchen; Josef Windele, Puchheim, all of Germany

[73] Assignee: Siemens Nixdorf Informationssysteme Aktiengesellschaft, Paderborn, Germany

[21] Appl. No.: 428,116

[22] PCT Filed: Oct. 12, 1993

[86] PCT No.: PCT/EP93/02806

§ 371 Date: Apr. 20, 1995

§ 102(e) Date: Apr. 20, 1995

[87] PCT Pub. No.: WO94/09410

PCT Pub. Date: Apr. 28, 1994

[30] Foreign Application Priority Data

Oct. 22, 1992 [DE] Germany ..... 921 18 107.9

[51] Int. Cl.[6] ..... G03G 15/20

[52] U.S. Cl. ..... 355/259; 219/216

[58] Field of Search ..... 355/285, 289, 355/290; 219/216, 388; 430/124; 432/59

[56] References Cited

U.S. PATENT DOCUMENTS 4,147,922 4/1979 Naeser et al. .
4,835,573 5/1989 Rohrer et al. .

OTHER PUBLICATIONS

*Patent Abstracts of Japan,* vol. 9, No. 320, "Heating Element", Izumi Tagiwa, Dec. 14, 1985.
*Patent Abstracts of Japan,* vol. 10, No. 190, "Fixing Device", Hiroomi Ozawa, Jul. 4, 1986.
*Patent Abstracts of Japan,* vol. 13, No. 120, "Heat Roller Fixing Device", Karasawa Kazuhiro et al., Mar. 24, 1989.
*Photographic Science and Engineering,* vol. 27, No. 1, "Relationships between Toner Properties, Fuser Parameters, and Fixing of Electrophotographic Images", R. Bruce Prime, pp. 19–25, Jan./Feb. 1993.

*Primary Examiner*—Joan H. Pendegrass
*Attorney, Agent, or Firm*—Hill, Steadman & Simpson

[57] ABSTRACT

A thermofixiug device for fixing toner images on a strip-shaped or sheet-like recording substrate (17) of an electrophotographic printing or copying machine contains a thermoprinting fixing station (11, 12) and a heated preheating saddle (15) located upstream of the thermoprinting fixing station in the recording substrate running direction. The preheating saddle (15) is designed as a low temperature saddle with the largest possible constructional length, so that the temperature difference between recording substrate (17) end saddle surface (24) is as small as possible. The preheating saddle has, in the recording substrate running direction, a plurality of heating zones (21, 23). A control device controls the heating zones (21, 23) in such a manner that, along the preheating saddle (15), an approximately constent thermal energy flow occurs on the saddle surface (24) to the recording substrate (17). For matching the preheating saddle (15) to various recording substrate widths, the preheating saddle is subdivided, transversely to the recording substrate heating direction, into individually drivable transverse heating zones (30/1 to 30/3).

39 Claims, 6 Drawing Sheets

SH
HS
HD
P1
SV
VS
VD
180
160
140
120
100
80
60
40
20
0
Y
[C°]
0
100
200
300
400
500
x
[mm]

THERMOFIXING DEVICE FOR A PRINTING OR COPYING MACHINES HAVING A LOW TEMPERATURE PREHEATING SADDLE

BACKGROUND OF THE INVENTION

The present invention generally relates to electrographic imaging machines such as copiers and printers. More particularly, the present invention relates to such machines which have a preheating saddle for heating a recording medium or substrate such as paper.

In printing or copying machines, for the thermo-printing fixing of toner images on a recording substrate such as paper, thermofixing devices are used which have a preheating saddle with a fixing zone connected downstream and comprising a heated fixing roller and nip roller.

Thermofixing devices of this type are, for example, known from U.S. Pat. No. 4,147,992 or Japan-Abstract Vol. 13, No. 120, Mar. 24, 1989 (JP-A-63-292177).

It is further known from U.S. Pat. No. 4,835,573 to match the temperature of the fixing station automatically to the thickness or to the basis weight of the paper.

In the case of the known fixing devices, it has previously been assumed that it is necessary to preheat the paper very rapidly over a relatively short path, via the preheating saddle, and then to fix the toner image on the paper via the rollers. For this purpose, the heating elements are arranged in the preheating saddle in such a way that the greatest quantity of heat is emitted to the recording substrate in the region of the paper inlet of the preheating saddle and that the emitted quantity of heat is then reduced over the heating elements in the direction of the paper exit. Thus, the relatively hottest region of the saddle is the paper inlet.

However, it has appeared that a rapid heating up of the paper over a short path leads to a high loading of the paper. This loading is expressed as a deformation, an embrittlement or an ageing of the paper and as a non-uniform loss of water from the paper during passage through the fixing station. Hence, post-processing of the paper by cutting or sorting is made more difficult or there occurs a non-uniform fixing of the toner images and thus an impairment of the quality of the print.

In addition, a rapid heating up requires a high specific heating power using high-power heating elements and a complicated control system. Because of the high heating power it is therefore necessary to lift the recording substrate immediately from the saddle in the event of a printer stop, in order to prevent burning of the paper. This makes comprehensive control devices necessary, which impairs the paper handling as a whole.

In modem electrophotographic printing devices, furthermore, recording substrates of the most different widths are processed in the same machine. If the same amount of energy is fed to the saddle over the entire width, the saddle heats up severely in that region where there is no paper running, since in this region no energy is dissipated, apart from losses due to convection.

A temperature distribution of this type has considerable disadvantages. The paper is heated up non-uniformly, which leads to fluctuations in the fixing quality and can also cause paper running problems. The maximum heating saddle temperature met be reduced, since there exists the risk of overheating of the heating elements end the lifetime of the heating elements is thereby shortened. The energy losses are relatively large and the inner region of the machine is heated up unnecessarily.

In the case of thermofixing devices with a preheating saddle, the recording substrate is guided over a heated gliding surface of the saddle. Direct contact between paper and saddle is essential for a good thermal transfer between paper and saddle surface. In the case of high printing speeds and in the use of pre-folded papers or papers of non-uniform thickness, fluttering movements of the paper can occur in the region of the saddle. In consequence, the paper lifts partially off from the saddle, which impairs the thermal transfer. Also, paper contains a relatively high proportion of water, which is released during warming. The released steam can be deposited in the machine and can lead there to disturbances or to corrosion.

SUMMARY OF THE INVENTION

It is therefore an object of the invention provide a thermofixing device and a process for fixing, in which the recording substrate is exposed to as small a thermal loading as possible during passage through the fixing device.

It is a further aim of the invention to provide a thermofixing device which makes it possible, without fluctuations of the fixing quality, to fix recording substrates of the most different widths and in which warping and deformations of the fixed recording substrate are avoided.

These objects are achieved by providing a thermofixing device which has a controlled arrangement of various heating zones. To this end, according to an embodiment of the present invention a thermofixing device for fixing toner images on a strip-shaped or sheet recording substrate is provided for an imaging machine, such as a printing or copying machine. The thermofixing device includes a thermoprinting fixing device, such as heating roller and a nip roller, for thermoprinting fixing of toner images on the recording substrate. A heated preheating saddle arrangement is located upstream of the thermoprinting fixing device relative to a running direction of the recording substrate for preheating and guiding the recording substrate. The preheating saddle arrangement includes is divided into a plurality of longitudinal heating zones or saddles which define a gliding surface. Each of these saddles extends perpendicularly across the running direction the width of the gliding surface and has a plurality of heating elements which uniformly heat the gliding surface. The gliding surface receives the recording substrate thereon. The heating saddles have a plurality of associated temperature sensors for determining a surface temperature of the gliding surface. A means for controlling the heating elements receives signals from the temperature sensors and analyzes:

a) a desired surface temperature entered via peripheral entry means;

b) at least one selected operating parameter, such as the type of material of the recording substrate, basis weight, or printing speed, and c) relationships, which can be determined empirically and stored in memory elements in allocation tables, between the parameters mentioned under a) and b), on the one hand, and the thermal energy flow or coefficient of temperature rise, on the other hand.

The means for controlling controls the surface temperature of the heating saddles so that, along the preheating saddle arrangement an approximately constant thermal energy flow occurs from the gliding surfaces to the recording substrate. Also, the preheating saddle arrangement is a low temperature saddle with a minimum total length of the heated gliding surfaces at which a coefficient of temperature rise in the recording substrate dependent on the recording substrate material is not exceeded.

In an embodiment, the recording substrate is paper or paper-like material has a coefficient of temperature rise of a maximum of 180° Kelvin per second.

In an embodiment, the preheating saddle arrangement has a first heating saddle of low temperature for preheating and a second heating saddle of higher temperature forming a heating saddle. The second heating saddle is arranged downstream of the first heating saddle relative to the paper running direction.

In an embodiment, the preheating saddle arrangement is divided into or formed by a plurality of transverse heating zones. These heating zones are parallel and adjacent to each other and parallel to the running direction. Each heating zone is individually selectively operable corresponding to the width of the recording substrate.

In an embodiment, at least one of the temperature sensors corresponds to each transverse heating zone and is arranged transversely to the recording substrate running direction, approximately centrally to the respective heating zone.

In an embodiment, a first of the transverse heating zones corresponds to a minimum recording substrate width. Second and third transverse heating zones are disposed adjacent to the first transverse heating zone. The second and third transverse heating zones extend from the first transverse heating zone and are actuated according to whether the recording substrate width overlaps one of these zones.

In an embodiment, openings are disposed in the gliding surfaces. The openings are connected to a suction device producing a vacuum.

In an embodiment, the openings are slot-shaped depressions having lateral suction openings. The openings extend over the width of the heating saddles.

In an embodiment, the preheating saddle has a domed or convex gliding surface. The gliding surface has a radius dimensioned such that, during a fixing operation, the recording substrate rests on the gliding surface over the entire saddle length.

Also, the present invention provides a process for fixing toner in an image on a recording substrate. The process includes preheating the recording substrate to a melting temperature corresponding to a melting point of the toner. Heat is supplied to the recording substrate such that an approximately uniform thermal energy flow to the recording substrate occurs and such that a coefficient of temperature rise, which is dependent on the recording substrate material, is not exceeded. Also, the process includes fixing the toner image on the preheated recording substrate by applying pressure and by heating the toner image to a toner melting temperature.

In an embodiment, the melting temperature of the toner is approximately between 100° to 140° C.

In an embodiment, the toner includes thermally fixable toner particles of a polymeric compound, at least 25% by weight of the toner particles comprising a covalent or ionically crosslinked polymer having polyester or styrene.

If the saddle is configured as a low temperature saddle with as large a constructional length as possible, so that the temperature difference between recording substrate and saddle becomes as small as possible, and if, furthermore, the saddle is subdivided in the recording substrate running direction into heating zones which are individually controllable and uniformly heated, the heating zones can then be controlled in such a way that, along the saddle, an approximately constant thermal energy flow occurs from the saddle to the recording substrate.

By means of this measure, the thermal loading for the recording substrate becomes very low. Nevertheless, the thermofixing device can also be used in printing devices of high and very high printing speed.

Furthermore, the subdivision of the saddle, transversely to the recording substrate running direction, into heating zones which can be driven as a function of the width of the recording substrate is of advantage.

In consequence, the heating behavior of the saddle can be matched directly to the width of the recording substrate running through, which guarantees a constant fixing quality, irrespective of the width of the recording substrate used.

In order to make possible a good contact between recording substrate and gliding surface of the saddle, irrespective of printing speed and paper used, in an advantageous embodiment of the invention, openings can be arranged on the gliding surface, the openings being connected to a device producing a vacuum. By means of the vacuum, the recording substrate is sucked flat onto the gliding surface and, in the process, the stem released in the paper is simultaneously sucked away via the openings.

Furthermore, if use is made for heating elements of heating cartridges which are arranged in passage openings of the heating saddle, the heating cartridges can easily be exchanged and saddle itself can be cost-effectively produced from an extruded profile.

A domed shaping of the gliding surface of the saddle ensures a force component, which presses the recording substrate against the saddle surface, over the entire saddle length. This measure supports the contact of the recording substrate on the saddle surface, stabilizes the recording substrate guidance end thus leads to an improved thermal transfer.

Additional features and advantages of the present invention are described in, and will be apparent from, the detailed description of the presently preferred embodiments and from the drawings.

In a further advantageous embodiment of the thermofixing device, peripheral entry means, for example in the form of a keyboard, are provided on the machine, via which means, by means of the entry of operating parameters such as paper weight, fixing temperature, etc., the heating power of the fixing device is automatically matched to these parameters.

BRIEF DESCRIPTION OF THE DRAWINGS

Embodiments of the invention are represented in the drawings end are described in the following by way of example in more detail.

DERAILED DESCRIPTION OF THE PRESENTLY PREFERRED EMBODIMENTS

Figure 1:
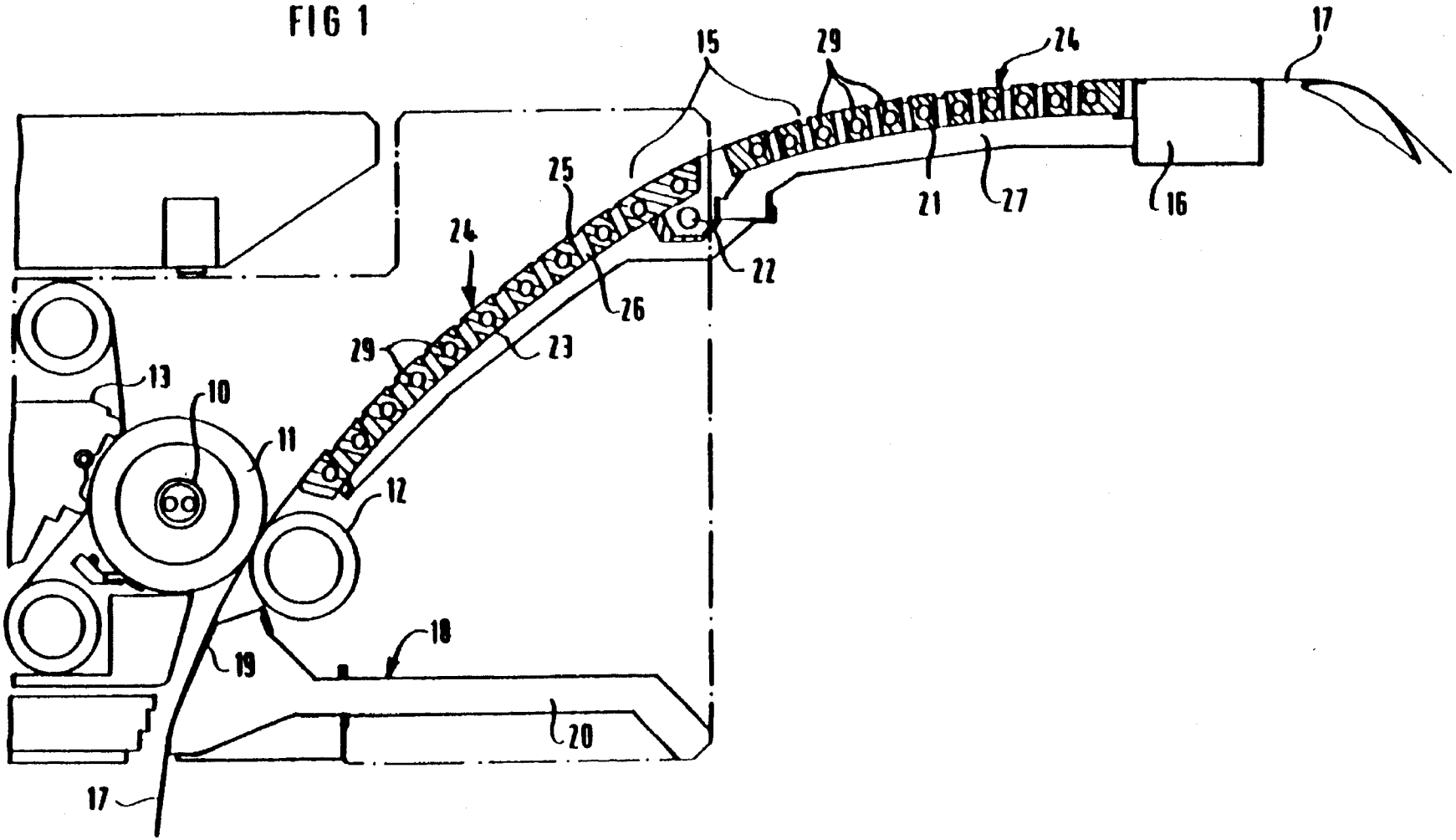
FIG. 1 shows a schematic sectional representation of a thermofixing device for an electrophotographic printing device.

In the case of the thermofixing of a recording substrate with a toner image arranged thereupon, in a fixing gap, under pressure end heat, the toner image comprising polymeric material, for example polyester, is heated via a heated fixing roller until in the melting range and is thus bonded with the recording substrate.

In this arrangement, the recording substrate, such as a paper sheet recording medium, is pressed against the fixing roller via one or more nip rollers. The boundary surface between the toner particles and the surface of the recording substrate is decisive for the fixing. In this region, the melting temperature of the toner must be reached carefully and without excessive heating, so that the toner bonds with the recording substrate or sticks to the latter. If, during fixing in the fixing zone (fixing gap), the recording substrate has an essentially lower temperature than the toner, heat is withdrawn from the boundary surface via the recording substrate, which can lead to faulty fixing. For this reason, the recording substrate with the toner image arranged thereon is preheated before feeding into the fixing gap. In this case it is favorable if the recording substrate is preheated to a temperature which already lies in the melting range of the toner material. In this range, which lies between 90°–125° in the case of a polymeric toner, the toner is already slightly sticker at the boundary surface with the recording substrate, which facilitates the actual fixing in the fixing gap. In the case of printing and copying machines which operate with endless paper, the recording substrate is commonly preheated via a preheating saddle, over which the recording substrate glides with its non-toner-laden side and thus picks up heat. In this case, the problem arises that the heat is picked up on the side facing away from the toner, so that heating of the boundary surface with the toner thus takes place only after heating of the actual recording substrate. As a function of the thickness of the recording substrate material end of its structure and of the printing speed, this requires a rapid supply of heating power via the preheating saddle. The processes in thermofixing are extensively described U.S. Pat. No. 3,938,992, whose publication is a constituent of this application.

For preheating the recording substrate to a temperature in the melting range of the toner material, a heating power which is essentially dependent on the temperature difference between entry end exit temperature and the thermal capacity of the recording substrate must be supplied to the recording substrate in the preheating zone.

Now, it has appeared that in the supply, of the heating power, which is too rapid and non-uniform, lasting deformations occur due to a temperature shock occurring in the recording substrate, said deformations being in the form of waves or bulges which influence the fixing process as a whole and in particular the post-processing of the printed recording substrate in a negative way. For this reason it is favorable to heat the recording substrate as slowly as possible and as uniformly as possible in the preheating zone. The coefficient of temperature rise was established as an essential criterion for the speed with which the recording substrate can be heated without lasting deformations. The coefficient of temperature rise, measured in degrees Kelvin per second, denotes a limiting value for a permissible temperature rise per second during heating of the recording substrate. It is a material-dependent value, which can be determined by experiments. In this case, material samples are thermally loaded dynamically as a function of time end examined for any lasting deformations and warping. In the case of paper as recording substrate material, it was established that the coefficient of temperature rise is dependent on the basis weight (grammage, weight per unit area). The heavier the paper is, the smaller is the coefficient. This means that heavy papers must be heated up more slowly than thin light papers in order to avoid warping. However, if different paper grades are processed in a printing or copying machine, the geometry end the type of the preheating of the thermofixing device must be designed in accordance with this heaviest paper grade. The coefficient of temperature rise of the paper is 120 K/sec. at 160 g/m$^2$ basis weight; 155 K/sec. at 70 g/m$^2$ basis weight.

The temperature coefficient is thus an essential parameter in the dimensioning of the length of the preheating zone or of the preheating saddle used for the heating. If the necessary heating power to be supplied has been determined as a function of the melting temperature which is to occur end of the heaviest recording substrate material to be used end of other parameters, such as printing speed, the necessary heating zone length or gliding surface length on the preheating saddle can be determined whilst keeping the other boundary conditions, such as constant specific power distribution (watts per cm) or uniform thermal energy flow (watts per area) along the saddle, at a minimum temperature difference between saddle surface end recording substrate. For this purpose, by way of example, proceeding from a calculated saddle length in a physical experimental construction, by means of infrared measuring devices operating without contact, the surface temperature of the recording substrate at the entry onto the saddle surface and on leaving the saddle surface is measured in the case of the heaviest recording substrate with the highest permissible printing speed and the temperature rise per second is determined therefrom. By means of comparing with the previously determined coefficient of temperature rise of the recording substrata material, an optimization is possible, the constructional length having to be dimensioned at least in such a way that the temperature rise lies below the coefficient of temperature rise. However, it should be pointed out that the coefficient of temperature rise is a statistical limiting value which, if exceeded, leads to the occurrence of a lasting quantitative material structure change, which makes itself noticeable in a disturbing manner.

Thus, if the minimum saddle length and the saddle construction have been optimized for the worst case, the saddle length can be kept for other lighter papers. However, it is occasionally necessary, in accordance with the reduced heating power necessary for recording the thinner recording substrate, to match said heating power correspondingly. In order that this process is carried out automatically, an entry keyboard for the entry of operating parameters, such as basis weight of the paper, printing speed, etc., can be provided on the machine. A computer-controlled device arranged in the machine, for example within the framework of the machine control system, then automatically determines the necessary heating power and sets it on the heating elements of the heating zone.

In the case of a preheating saddle as is shown in FIG. 1, which is composed of a preheating saddle and a heating saddle, the following relationship resulted for the calculation of the total heating saddle power.

$P_{max} = P_{Pap} + P_{H2O} + P_{H2Osteam} + P_{convect}$
$P_{max} = G_{Pap.max} \times v_{Pap} \times b_{Pap.max} \times c_{Pap} \times T_{Pap.} + (G_{H20max}/A^*) \times v_{Pap} \times b_{Pap.max} \times C_{H2O} \times T_{H2O} \times + (q_{H2O} + G_{H2Osteam})/t_{2000\ sheets} + Pconvect.$
$P_{max} = 5895\ W + 1343\ W + 1608\ W + 300\ W$
$P_{max} = 9146\ W$
Description of the parameters and their values:
These values are true for the most unfavorable conditions (heaviest paper, widest paper, maximum proportion of water)

| | | | |
|---|---|---|---|
| Temperature of the paper preheating | $T_{Pap.}$ | = | 100° C. − 25° C. = 75 K |
| Speed of the paper web | $V_{Pap.}$ | = | 0.86 m/s |
| Maximum specific paper weight | $G_{Pap.max}$ | = | 0.16 kg/m$^2$ |
| Maximum paper width | $b_{Pap.max}$ | = | 0.457 m |
| Specific heat of paper | $c_{Pap.}$ | = | 1250 J/(kg × K) |
| Maximum $H_2O$ proportion per 2000 sheets | $G_{H2Omax}$ | = | 3.2 kg |
| Heating temperature of the $H_2O$ | $T_{H2O}$ | = | 70 K |
| Evaporated $H_2O$ proportion per 2000 sheets | $G_{H2Osteam}$ | = | 0.5 kg |
| Heat of evaporation of $H_2O$ | $q_{H2O}$ | = | 2281 × 10$^3$ J/kg |
| Specific heat of $H_2O$ | $c_{H2O}$ | = | 4180 J/(kg × K) |
| Running time for 2000 12-inch sheets | $t_{2000\ sheets}$ | = | (609.6 m)/(0.86 m/s) = 709 s |
| Area of a 2000 × 12-inch-sheet long paper web | A* | = | 274 m$^2$ |

The power is distributed uniformly over the length of heating and preheating saddle. That means that, at a length of the heating saddle of 300 mm and a length of the preheating saddle of 240 mm, there results a specific power distribution in the paper running direction of 169 W/cm.

An electrophotographic printing device for printing endless papers contains a thermofixing device shown schematically in FIG. 1. The thermofixing device is designed as a thermoprinting fixing device. It contains a heating roller 11, heated via a radiator 10, and a nip roller 12, which can be pivoted on and off the heating roller 11 by an electric motor. The heating roller comprises an aluminum cylinder with a heat-proof coating arranged thereon, the nip roller likewise comprises an aluminum cylinder with a coating of silicon. The heating roller 11 is driven by an electric motor. The heating roller 11 has assigned to it an oiling device 13 for the application of release oil to the heating roller. Supported upstream of the rollers in the recording substrate transport direction is a heated preheating saddle 15 with associated vacuum brake 16, which serves to preheat a recording substrate 17 designed as endless paper and to feed it in the preheated state to the actual fixing gap between the rollers 11 and 12. Braked by the vacuum brake 16 and driven via the rollers, the recording substrate 17 is fed tautly over the preheating saddle 15. A loose toner image located on the recording substrate is preheated on the preheating saddle 15 and is fixed by means of heat and pressure between the rollers 11 and 12.

A cooling device 18 arranged downstream of the rollers 11 and 12 in the paper running direction ensures cooling of the heated paper. For this purpose, the cooling device 18 contains a cooling surface 19, which is provided with openings and is swept over by the recording substrate 17, cold air supplied via an air supply 20 flowing out of the openings and a cooling air cushion being produced underneath the recording substrate 17. Simultaneously, air is blown onto the toner-laden side of the recording substrate via an opposite profile.

In the case of the thermofixing device described, the preheating of the continuous supply of paper or endless paper 17 takes place over a preheating saddle arrangement 15, which comprises two heated saddles connected one after another, specifically a preheating saddle 21 in a fixed position and a heating saddle 23 which can be pivoted about a point of rotation 22. Preheating saddle 21 and heating saddle 23 form two separate heating zones, seen in the paper running direction. The entire preheating path in this arrangement has a length of approximately 500 mm to 700 mm. During the preheating, the paper 17 glides with its toner-free side on gliding surfaces 24 of the preheating saddle 21 and heating saddle 23.

In order to provide good contact between the saddles and the paper and thus to keep the temperature difference small, the gliding surfaces and the saddles are designed to be domed, having a doming radius which is 700 mm in the case of the example shown. By means of the doming of the gliding surfaces, in conjunction with the tension caused by the rollers 11 and 12 and the braking caused by the vacuum brake 16, a force component which presses the paper 17 onto the gliding surfaces 24 acts over the entire saddle length. Moreover, the stability of the paper run on the saddle is endangered thereby. As can be seen in addition from FIG. 2, the saddles 21 and 23 have elongated depressions 25 transversely to the paper running direction and extending over the entire width of the saddles. They are co-acted by means of lateral holes 26 to a vacuum channel 27. The vacuum channel runs underneath the saddles and is connected to a vacuum-producing device, for example a pump. By means of the vacuum, the recording substrate (paper) is sucked onto the gliding surfaces 24 of the saddles and the steam released by the preheating is sucked away.

The heating of the saddles 21 and 23 is carried out by means of electrical resistance elements in the form of heating cartridges 28 which are arranged so that they can be exchanged. To accommodate the heating cartridges 28, the saddles 21 and 23 have continuous holes 29. These holes enable the exchange of each individual heating cartridge 28 in the event of a defect. Moreover, the saddles 21 and 23 can thus be cost-effectively produced from extruded aluminum profile.

Figure 2:
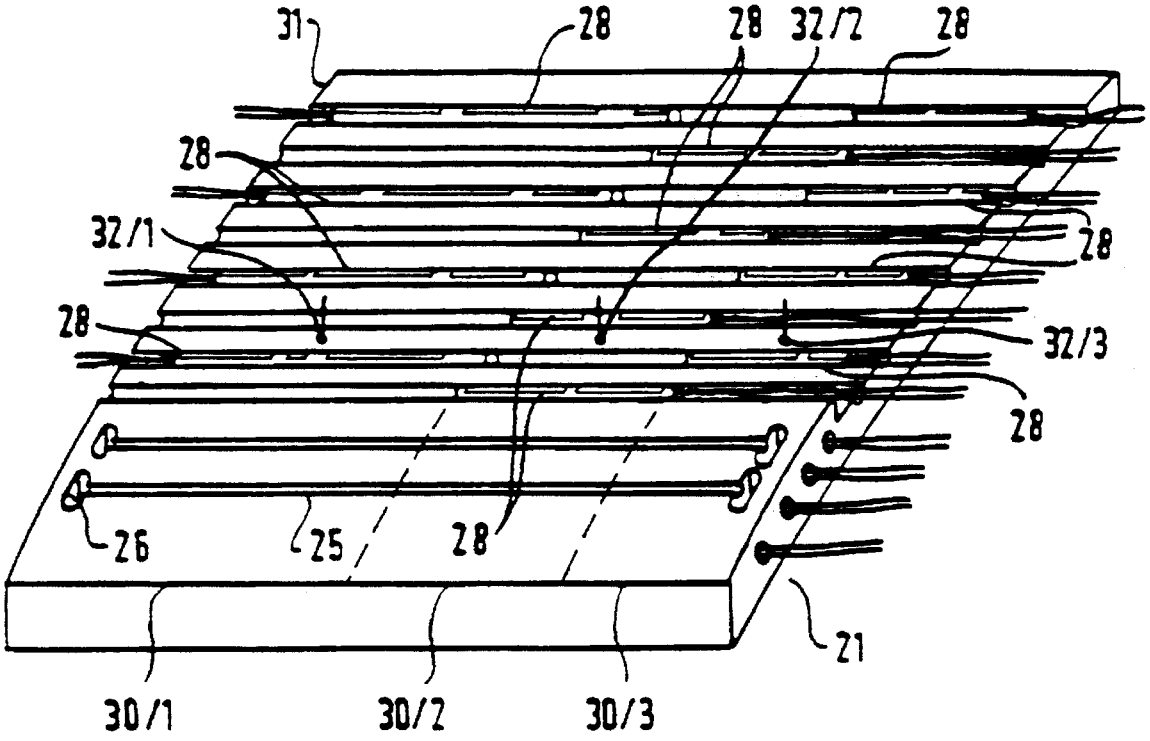
FIG. 2 shows a schematic representation of a heated saddle, used in the thermofixing device, with heating cartridges arranged therein.

By means of the arrangement of the cartridges in the saddles, each saddle 21 and 23, respectively, is subdivided into three heating zones 30/1, 30/2 end 30/3, transversely to the paper running direction (FIG. 2). These transverse heating zones 30/1 to 30/3 are used for matching the saddles to various recording substrate widths. The first heating zone 30/1 is limited on one side by the fixed paper running edge 31. This heating zone 30/1 is as wide as the minimum recording substrate width. The remaining region of the saddles, up to the maximum recording substrate width, is subdivided into the equally wide heating zones 30/2 and 30/3. Each of the transverse heating zones 30/1 to 30/3 has a temperature sensor 32/1 to 32/3 for controlling the heating zones. The temperature sensor is located in each case transversely to the paper running direction approximately in the center of the respective heating zones. Seen in the paper running direction, the sensor positions are selected such that control is possible to the same temperature both in the standby condition of the printing device (standby) and in the printing operation itself. In this way, the temperature control is simplified. The control temperature and the position of the sensors 32/1 to 32/3 are selected in such a way that the paper temperature at the end of the saddle during the start phase is just as high as during a longer printing phase. In this arrangement, the region from the center as far as the last third of the saddles has proved to be a favorable sensor position.

The heating zones 30/1 to 30/3 are produced by means of the arrangement of the heating cartridges 28 in the holes 29. This is as follows:

One cartridge in each case for the two outer heating zones 30/1 and 30/3 is pushed from both sides into the first hole, of a saddle, in the paper running direction. A heating cartridge 28 for the central zone 30/2 is pushed into the second hole. The third hole is equipped in the same way as the first, and so on. In this way, six heating cartridges 28 are located in each heating zone 30/1 to 30/3.

Figure 4:
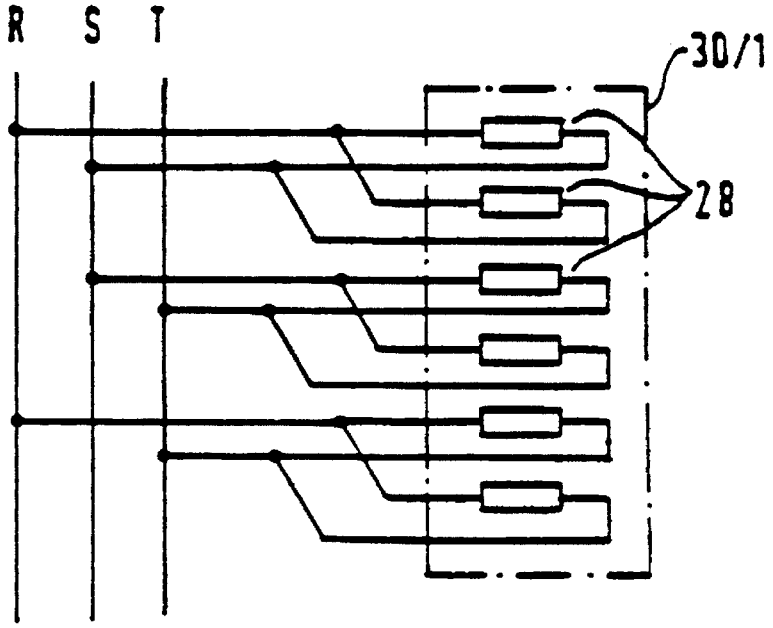
FIG. 4 shows a schematic representation of the wiring of the heating elements in the saddle in the case of operating the printing device on a three-phase power supply in accordance with the U.S. standard.
Figure 5:
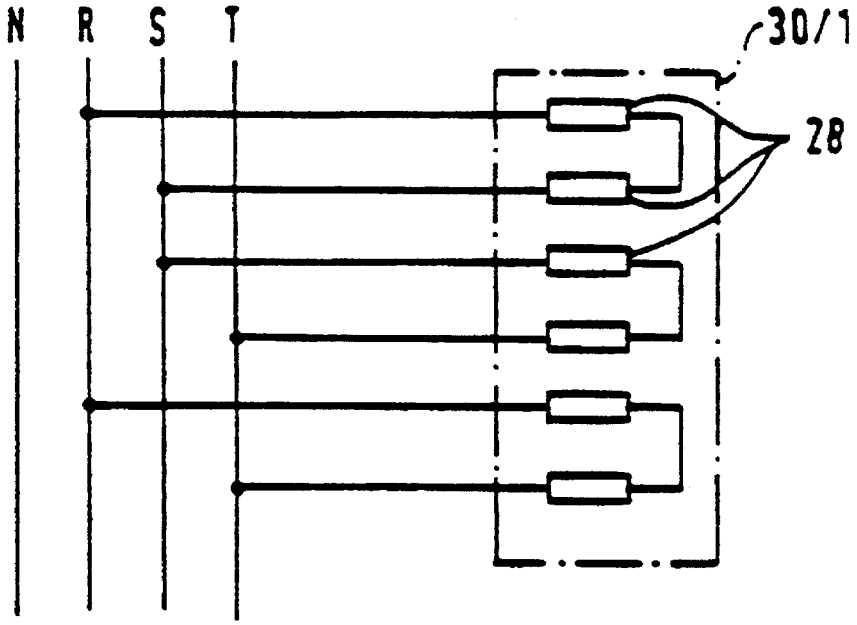
FIG. 5 shows a schematic representation of the wiring of the heating elements in the case of operating the printing device on a three-phase power supply in accordance with the European standard.

As shown in FIGS. 4 and 5, the heating cartridges 28 of the heating zones 30/1 to 30/3 are operated on phases R, S, T and N of a three-phase power supply. As a function of the type of the three-phase power supply (USA, Europe), the heating cartridges are connected in pairs in series (FIG. 5) (European three-phase power supply) or in parallel (FIG. 4) (three-phase power supply USA).

There are thus three pairs of heating cartridges located in each heating zone 30/1 to 30/3. In order to achieve a uniform loading of all three phases, the connection is carried out of a first heating cartridge pair to the phases R, S; of a second heating cartridge pair to the phases S, T; and the connection of a third heating cartridge pair to the phases R, T. However, the possible wiring, of the individual heating cartridges 28, specified in FIGS. 4 and 5 can be varied as desired as a function of the operating power supply used.

Figure 3:
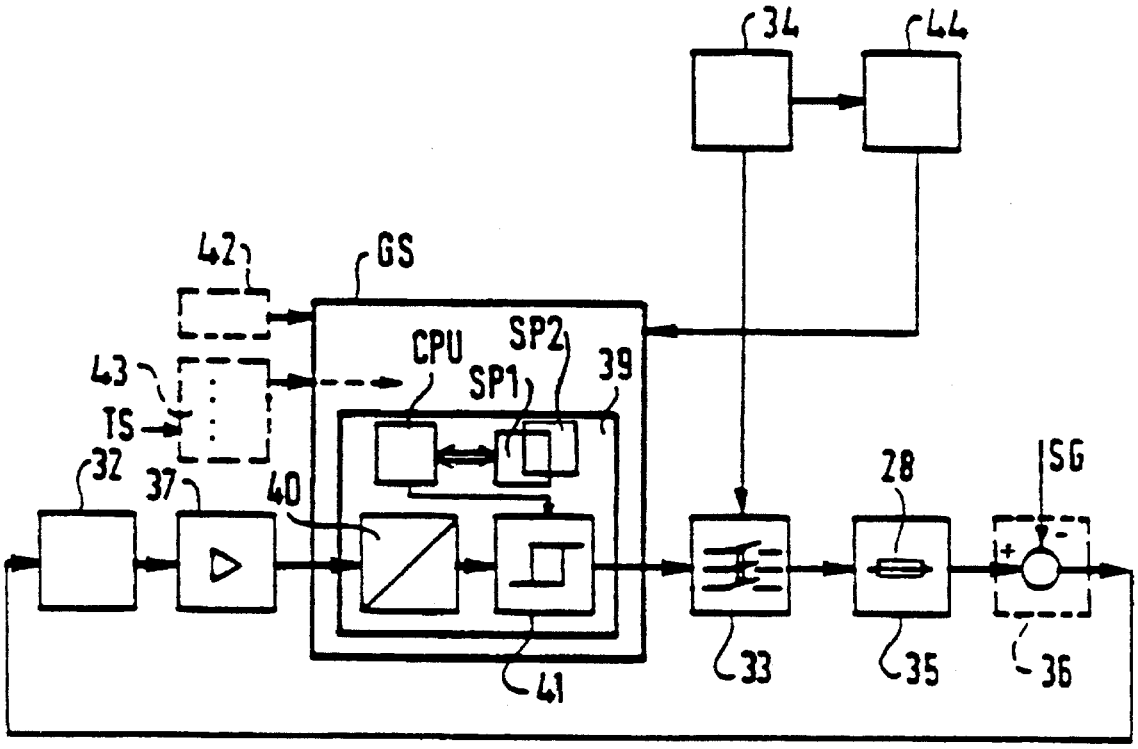
FIG. 3 shows a block circuit diagram of a control arrangement for controlling a heating zone of the saddle.

The surface temperature of the saddles and thus the temperature of the recording substrate is controlled with the aid of a control arrangement, as is shown in FIG. 3.

The control arrangement contains an actuator 33, for example in the form of individual relays for coupling the heating cartridges 28 to a power supply unit 34. Connected downstream of the actuator is the control path 35 with the heating cartridges 28. The actual temperature is registered via the temperature sensors 32/1 to 32/3 end converted by the sensors into an electrical drive signal and amplified in a subsequent simplifier 37. A control arrangement 39 compares the actual temperature with a predeterminable desired temperature TS and controls to the desired temperature TS as a function of the control deviation.

The microprocessor- controlled control arrangement 39 contains an analog-digital converter 40 with associated program-controlled two-state controller 41. Furthermore, it has a central unit CPU, which is connected to corresponding areas of memory SP1 and SP2. In addition, the microprocessor-controlled control arrangement 39 is coupled to the controller 42 of the printing device, which is commonly constructed with an operating panel 43 on the machine. The entire control arrangement can be a component of the machine control system of the machine. An additional low-voltage power supply unit which is coupled to the actual power supply unit 34, ensures the power supply of the machine control system and thus of the microprocessor-controlled control arrangement 39.

As already explained at the beginning, in the use of recording substrates of different material structure, in particular different basis weight, the heating power which is fed to the preheating saddle must be correspondingly matched. This is similarly true for the matching of the saddle exit temperature to the recording substrate to be printed. In order to be able to adjust this heating power or other parameters on the preheating saddle, such as for example the exit temperature, the machine contains an operating panel 43 for the entry of various operating parameters, such as basis weight of the recording substrate, desired exit temperature at the preheating saddle, etc. The operating panel is connected to a computer-controlled arrangement which can be a part of the control arrangement 39 and which contains a central unit CPU, which is co-acted to corresponding memories SP1 and SP2.

Stored in the memories SP1 to SP2 there are allocation tables or characteristics, via which, in accordance with entry of the corresponding parameters via the operating panel 43, the corresponding electrical values to be controlled and to be regulated of the preheating saddle are allocated. These values are then fed to the control arrangement 39 as desired value. In the exemplary embodiment shown, the desired temperature TS is entered via the operating panel 43, the temperature at which the paper leaves the saddle arrangement (preheating saddle 15) or the entry temperature of the paper into the fixing zone between the rollers 11 and 12 being designated as desired temperature. The statement of the operating parameters was only by way of example. In the case of a change of the printing speed or in the case of a change of the paper width, a matching of the heating power is likewise necessary. This takes place automatically by means of corresponding switching-in of the transverse heating zones 30/1, 30/2 and 30/3 designed to be individually drivable and arranged on the saddle 15 transversely to the recording substrate running direction, or by registering of the set printing speed, the variation of which indeed has an effect as a whole on many units of the machine. In the normal case, in electrophotographic printing devices which operate with endless paper, operations are carried out at a constant recording substrate advance speed (printing speed).

Figure 6:
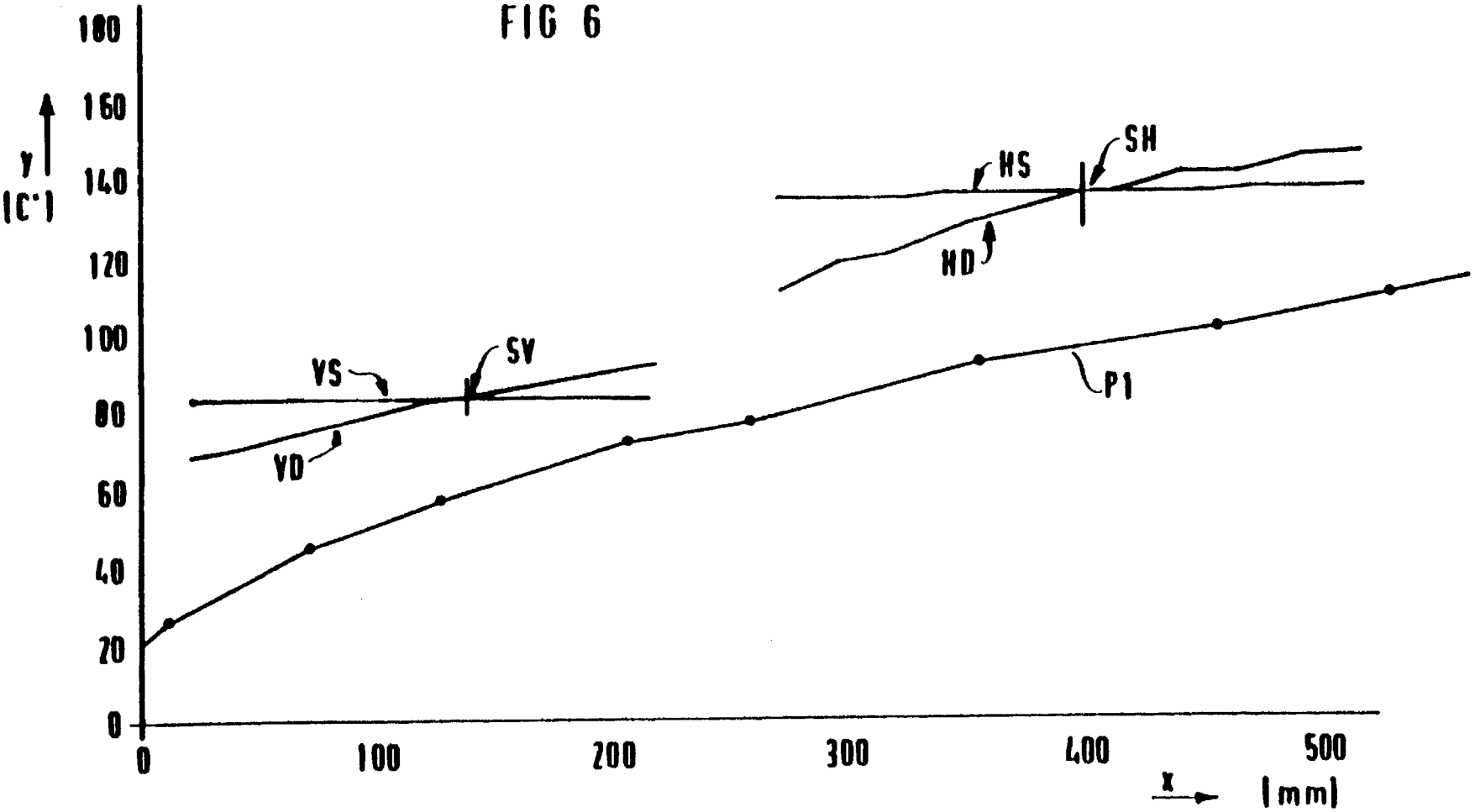
FIG. 6 shows a representation of the temperature curve along the saddle in the paper running direction.

The functioning of the control device is explained using the diagram of FIG. 6. The abscissa X of the diagram in this case designates the position in millimeters, proceeding from paper entry on the saddle surface, the ordinate Y designates the temperature in degrees Celsius. In this case, the temperature variation on the paper or recording substrate is represented in the curve P1. The curves VD end VS here designate the temperature variation on the saddle surface of the preheating saddle 21 in printing operation VD end in standby operation VS. The curves HD end HS the temperature variation in printing operation HD and standby operation HS on the heating saddle surface. The positions of the sensors of the preheating saddle and of the heating saddle are designated by SV end SH in the curves. In this context it should be noted that the diagram represents the temperature variation within the heating zone 30/1 both of the preheating saddle and of the heating saddle, specifically when only this heating zone 30/1 is active, that is to say a recording substrate of minimum width sweeps over the saddle. If recording substrates of other widths are used, a similar temperature variation is true in the case of additional activation of the heating zones 30/2 and 30/3.

The saddle temperature of the preheating saddle 15 is controlled by means of the control arrangement, specifically by means of controlling the heating zones, namely the heating saddle 23 and the preheating saddle 21. In so doing, the aim of the control is a constant desired saddle temperature, the exit temperature of the paper after leaving the saddle being able to be entered as saddle temperature, via the operating panel 43. The microprocessor-controlled control arrangement 39 then converts this desired saddle temperature into corresponding desired temperatures on the preheating saddle 21 and on the heating saddle 23 and controls these together. The level of the desired temperature to be set depends on the type and the material construction of the recording substrate used and on the printing speed, that is to say the paper advance of the machine. In the case of normal paper and a printing speed corresponding to a paper advance speed of approximately 0.89 m/sac, the paper at the saddle inlet has a temperature of 20° and is intended to be heated to a paper exit temperature of approximately 100°. The heating cartridges 28 are now arranged along the heating zones 21 and 23 of the saddle 15 in such a manner and are controlled in such a manner that the thermal energy flow per surface from the saddle to the paper is constant along the saddle. Furthermore, the length of the saddle is fundamentally determined such that the temperature difference $\alpha$ T between saddle surface (gliding surface) and paper becomes constant end as small as possible. The length of the saddle is limited, however, by the maximum constructional length available and can vary from machine to machine. However, as large a length as possible is the aim, so that most careful heating-up of the paper is achieved.

In this case, one problem is the dynamic behavior of the temperature variation at the transition from the standby or start phase to printing operation. In the start phase, that is to say without paper or with paper deposited in the standby condition, thermal dissipation from the saddle takes place simply by means of convection. Nevertheless, it must be ensured that the paper is not excessively heated in the start or standby phase. This is ensured by means of the saddle construction described and by means of the control.

In this arrangement, both in standby operation and in printing operation, the ten, stature of the saddle is kept constant, the preheating saddle having a temperature of approximately 80° and the heating saddle a temperature of approximately 130°. The result is thus the temperature variation which can be seen in FIG. 6. In standby operation, the preheating saddle has the temperature of 80° over its entire surface, corresponding to the curve VS, and the heating saddle has the temperature of 130° over its entire surface, corresponding to the curve HS. After initiation of printing operation, the temperature variation tilts around the sensor positions SV and SH, so that the steady-state temperature variation represented by the curves VD and HD is set in printing operation. In this steady-state condition, the temperature difference $\alpha$ T between saddle surface and paper is approximately constant along the saddle surface.

A still more exact setting of the constant temperature difference is possible, if the number of controlled heating zones is increased. However, this leads to an additional expenditure. As shown, the condition can also be approximately achieved using one saddle which has two heating zones, namely preheating saddle and heating saddle. In detail, the control sequence is as follows:

After laying the paper in the printing device and threading through the fixing station, the desired temperature TS is entered via the operating panel 43, corresponding to the paper used. The microprocessor-controlled control arrangement 39 connects the heating cartridges 28 to the phases of the three-phase power supply of the power supply unit 34 via the actuator 33. After the desired temperature is reached, the operational readiness of the fixing station is communicated to the controller 42 of the machine. After-printing operation is initiated, heat is withdrawn from the saddle via the paper as a function of the paper temperature, the paper basis weight, the printing speed, the paper thickness, the surface finish of the paper and the width of the paper. This disturbance variable influence is symbolically represented in the control loop of FIG. 3 as disturbance variable SG. The actual temperature resulting after subtracting the disturbance variable is registered via the temperature sensors 32/1 to 32/3 and fed in the form of electrical signals to the microprocessor-controlled control arrangement 39. The latter activates the actuator 33 in a corresponding manner until the prescribed desired temperature is reached and the temperature profile which can be seen in FIG. 6 occurs.

Figure 7:
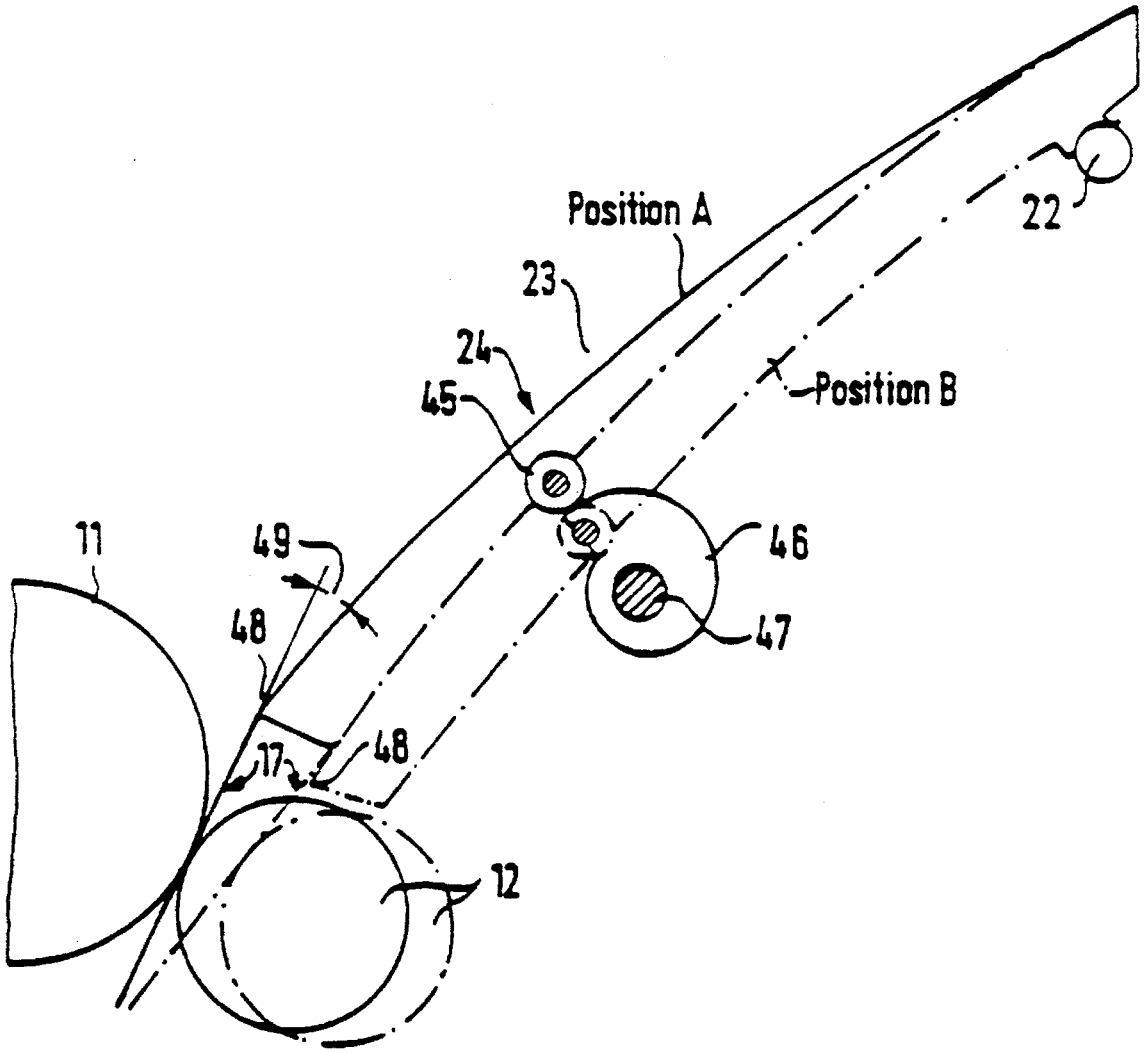
FIG. 7 shows a schematic representation of a heating saddle having a smoothing edge.

As described at the beginning in conjunction with FIG. 1, the heating saddle 23 of the preheating saddle 15 is arranged in the machine so as to be pivotable. For this purpose—as can be seen in FIG. 7 —the heating saddle is supported at its input end in a pivotable and detachable manner via a bearing 22 in the machine frame. The heating saddle has, approximately at its center, a cam roller 45 which is rotatably supported on the heating saddle and cooperates with an eccentric snail cam 46 supported movably in the machine frame. The eccentric snail cam 46 is driven via a camshaft 47, which is connected to a stepping motor, not shown here. By means of rotating the eccentric snail cam 46, the heating saddle 23 rotates about the point of rotation 22. Hence, it can be positioned in different positions as a function of the operational conditions of the machine, namely into an operating position (position A; shown in FIG. 2 with continuous lines) assigned to the fixing operation, with nip roller 12 pivoted in, and into a standby position (position B; shown in FIG. 2 with interrupted lines) assigned to the standby operation, with nip roller 12 pivoted out. In the standby position, the recording substrate 17 is pivoted away from the hot fixing roller 11. Furthermore, however, it is in contact with the heated preheating saddle 15.

In the preheating of the recording substrate 17, be it now of paper or paper-like material or, for example, of plastic, there exists the problem that, as a result of the gassing out of the recording substrate material or as a result of other effects such as loss of water, etc., the recording substrate will shrink, which leads to some reduction in width. Hence, in the transition into the unheated paper running region, small waves or warping occur.

This effect is to be observed in particular in standby operation, in which, in the case of a continuously heated heating saddle, the immobile recording substrate is exposed for a very long time to the heat from the heating saddle. If then, in the event of a renewed initiation of printing operation, the saddle is brought into the operating position by pivoting in and the preheated recording substrate is fed in the fixing gap between fixing roller and nip roller, the warping produced during the passage through the fixing gap is ironed into the recording substrate by means of pressure and heat, which disturbs the printed image appreciably.

In order to prevent this, the heating saddle 23 has, at its end assigned to the fixing gap, a smoothing edge 48, which is designed as a relatively sharp-edged rounding of the gliding surface 24. If, on leaving the heating saddle 23, the recording substrate web wraps around this heating saddle edge smoothing edge 48) arranged on the preheating saddle exit region, by as large an angle 49 as possible, this warping of the recording substrate is smoothed out over the wrapped-around saddle edge 48 before the entry into the fixing gap.

The heating saddle edge or smoothing edge 48 should in this case be positioned as close as possible to the fixing gap. A deflection angle of at least 7 degrees of angle or larger has proved to be advantageous, the smoothing effect also occurring to a limited extent already at 5° or 6° deflection angle. Designated by deflection angle 49 is the angle by which the running direction of the recording substrate 17 changes on leaving the gliding surface 24 of the heating saddle 23. In the examplary embodiment of FIG. 7, with a domed gliding surface 24 of the heating saddle 23, this is the angle between the gliding surface direction (tangential) in the region of the smoothing edge 48 and the feed direction of the recording substrate to the fixing gap between smoothing edge 48 and fixing gap.

So that the smoothing edge 48 does not press into the recording substrate 17 in the standby position (standby operation), the heating saddle 23 is pivoted out in standby operation to such an extent that the recording substrate 17 does not rest on the smoothing edge 48 or does not wrap around the latter.

In the exemplary embodiment, shown in FIG. 1, of the thermofixing device, the preheating saddle 15 consists of a fixed preheating saddle 21 and a heating saddle 23 which is arranged so as to be pivotable. Such a subdivision is also sensible because only a low saddle mass thus has to be pivoted over the heating saddle 23. In addition, the subdivision opens up the possibility of composing the preheating saddle 15 of heating zone modules, for example of a fixed heating zone module "preheating saddle" and a pivotable module "heating saddle" or else, by way of example, of a module forming the heating saddle end a plurality of modules forming the preheating saddle, which then form the preheating saddle 15 in combination. In this way, preheating saddles for various machine variants having, for example, a different printing speed can be constructed in a simple manner. If, for example, the printing speed and thus the recording substrate running speed of a machine variant are reduced, the preheating saddle length needed also reduces. If necessary, the "preheating saddle" module can thus be dispensed with completely and only a pivotable heating saddle module is necessary as preheating saddle. On the other hand, in the case of an increase of the printing speed, the preheating saddle length can be extended by the addition of further heating zone modules.

A crosslinked toner has emerged as a toner material which is particularly suitable for fixing on paper via the described thermofixing device. By means of the careful heating up in the fixing, the advantageous fixing properties, already present per se, of the crosslinked toner can be further improved. For example, there cam be used as crosslinked toner a toner which has at least 25 percent by weight of toner particles made of a polymer comprising a polyester or a polymer having styrene groups or a polymer comprising styrene groups, which is crosslinked covalently or ionically to such an extent that the melting range of the toner particles is increased by at least 10% in comparison with corresponding toner particles having a non-cross-linked polymer.

It should be understood that various changes and modifications to the presently preferred embodiments will be apparent to those skilled in the art. Such changes and modifications may be made without changing the spirit and scope of the present invention and without diminishing its attendant advantages. Therefore, such changes and modifications are intended to be covered by the appended claims.

What is claim is:

1. A thermofixing device for fixing toner images on a sheet recording substrate in an imaging machine, the thermofixing device comprising:

a thermoprinting fixing device for thermoprinting fixing toner images on the recording substrate;

a heated preheating saddle arrangement, which is located upstream of the thermoprinting fixing device relative to a running direction of the recording substrate for preheating and guiding the recording substrate, the preheating saddle arrangement including: in a plurality of heating saddles defining a gliding surface, each heating saddle extending perpendicularly across the running direction and having a plurality of heating elements, wherein the heating elements uniformly heat the gliding surface, the gliding surface, receiving the recording substrate thereon, the heating saddles having a plurality of associated temperature sensors for determining a surface temperature; a means for controlling the heating elements, the means for controlling receiving signals from the temperature sensors and analyzing:

a) a desired surface temperature entered via peripheral entry means;

b) at least one selected operating parameter; and c) relationships among the desired surface temperature, the selected operating parameters and the thermal energy flow or coefficient of temperature rise, so that the means for controlling controls the surface temperature of the heating saddles so that, along the preheating saddle arrangement, an approximately constant thermal energy flow occurs from the gliding surfaces to the recording substrate;

wherein the preheating saddle arrangement is a low temperature saddle with a minimum total length of the heated gliding surfaces at which a coefficient of temperature rise in the recording substrate dependent on the recording substrate material is not exceeded.

2. The thermofixing device as claimed in claim 1, wherein the recording substrate is paper having a coefficient of temperature rise of a maximum of 180° Kelvin per second.

3. The thermofixing device as claimed in claim 1, wherein one of the sensors is positioned in a region approximately centrally up to the last third of the preheating saddle arrangement in the recording substrate running direction.

4. The thermofixing device as claimed in claim 1 wherein the preheating saddle arrangement has a first heating saddle of low temperature for preheating and a second heating saddle of higher temperature forming a heating saddle, the second heating saddle being arranged downstream of the first heating saddle relative to the paper running direction.

5. The thermofixing device as claimed in claim further comprising holes arranged in the saddle for removable mounting of the heating elements.

6. The thermofixing device as claimed in claim 5, wherein the first and second saddles are independent modules, the first saddle being fixed and the second saddle being pivotable.

7. The thermofixing device as claimed in claim 1 wherein the preheating saddle arrangement is formed by a plurality of transverse heating zones, the heating zones being parallel and adjacent to each other and parallel to the running direction, each heating zone being individually Selectively operable corresponding to the width of the recording substrate.

8. The thermofixing device as claimed in claim 7, wherein at least one of the temperature sensors corresponds to each transverse heating zone and arranged transversely to the recording substrate running direction, approximately centrally to the respective heating zone.

9. The thermofixing device as claimed in claim 7 Wherein a first said transverse heating zone corresponds to a minimum recording substrate width and wherein second and third said transverse heating zones are disposed adjacent to the first transverse heating zone.

10. The thermofixing device as claimed in claim 1 further comprising openings disposed in the gliding surfaces, the openings being connected to a suction device producing a vacuum.

11. The thermofixing device as claimed in claim 10, wherein the openings are slot-shaped depressions having lateral suction openings, the openings extending over the width of the heating saddles.

12. The thermofixing device as claimed in claim 1, wherein:

the preheating saddle has a convex gliding surface, the gliding surface having a radius such that, during a fixing operation, the recording substrate rests on the gliding surface over the entire saddle length.

13. The thermofixing device as claimed in claim 1, wherein:

the preheating saddle has, at one end facing the thermoprinting fixing device, a smoothing edge, over which the recording substrate is deflected out of a running direction determined in the region of the smoothing edge by the gliding surface into an approach direction towards the thermoprinting fixing device, the deflection angle being dimensioned such that a smoothing effect is exerted on the recording substrate.

14. The thermofixing device as claimed in claim 13, wherein the deflection angle is at least seven degrees.

15. The thermofixing device as claimed in claim 13, wherein the thermoprinting device includes a heated fixing roller; and wherein the preheating saddle is pivotably arranged in front of the fixing roller in the recording substrate running direction such that, in an operating condition for a fixing operation, the recording substrate is fed to the fixing roller over the smoothing edge and, in a condition assigned to a standby operation, is lifted off from the fixing roller, no deflection over the smoothing edge taking place.

16. The thermofixing device as claimed in claim 1, wherein the imaging machine is a copier.

17. The thermofixing device as claimed in claim 1, wherein the imaging machine is a printer.

18. The thermofixing device as claimed in claim 1, wherein the selected operating parameters are selected from a group consisting of the type of material of the recording substrate, basis weight and printing speed.

19. The thermofixing device according to claim 1 wherein the relationships which are determined empirically and stored in memory elements in the form of allocation tables.

20. A method for fixing a toner image on a recording substrate, comprising the steps of:

providing a toner fixing station for fixing of the toner image on the recording substrate by means of pressure and by heating the toner images to a melting temperature assigned to a melting range of a material of the toner image;

preheating the recording substrate before the fixing station in at least two separate zones which follow each other in a running direction of the recording medium; and providing a temperature sensor in each of the at least two preheating zones, and positioning heating elements in each of the two zones and independently controlling heating in each of the two zones separately from one another so that an approximately uniform thermal energy flow occurs to the recording substrate as the recording substrate moves through the two preheating zones to the fixing station.

21. The method according to claim 20 wherein a melting range of the toner material is 100° to 140° C.

22. The method according to claim 20 wherein the toner image contains thermally fixable toner particles of a polymeric compound, at least 25% by weight of the toner particles comprising a covalent polymer having polyester groups.

23. The method according to claim 20 wherein the toner image contains thermally fixable toner particles of a polymeric compound, at least 25% by weight of the toner particles comprising a covalent polymer having styrene groups.

24. The method according to claim 20 wherein the toner image contains thermally fixable toner particles of a polymeric compound, at least 25% by weight of the toner particles comprising an ionically crosslinked polymer having polyester groups.

25. The method according to claim 20 wherein the toner image contains thermally fixable toner particles of a polymeric compound, at least 25% by weight of the toner particles comprising an ionically crosslinked polymer having styrene groups.

26. A method for fixing a toner image on a recording substrate, comprising the steps of:

providing a toner image fixing station for fixing of the toner image on a preheated recording substrate by means of pressure and by heating the toner image to a melting temperature assigned to a melting range of a material of the toner image;

preheating the recording substrate in at least first and second zones sequentially preceding the fixing station in a running direction of the recording substrate, each zone having at least one temperature sensor; and controlling temperature in the first zone by use of the first temperature sensor to achieve a desired first temperature, and controlling temperature in the second zone by the use of the second temperature sensor to achieve a desired second temperature in the second zone independently of the first zone.

27. The method according to claim 26 including the step of providing heating elements in the first and second preheating zones such that in each zone they have a substantially equal spacing from a surface of the heating zone and also in a running direction of the recording substrate, and selecting the first and second temperatures to be regulated at the respective first and second sensors so that approximately uniform thermal energy flow occurs to the recording substrate as the recording substrate moves across the first and second zones to the fixing station.

28. A method for fixing a toner image on a recording substrate, comprising the steps of:

providing a fixing station for fixing of the toner image on a preheated recording substrate by means of pressure and by heating the toner image to a melting temperature assigned to a melting range of a material of the toner image;

providing a preheating zone for the recording substrate before the fixing station for preheating the recording substrate with controllable temperature as it travels along the preheating zone such that a coefficient of temperature rise, which defines a limiting value for a permissible temperature rise per unit time, and which is dependent on a material of the recording substrate, is not exceeded as the recording substrate travels along the preheating zone.

29. The method according to claim 28 wherein the recording substrate is a paper or paper-like material, and wherein temperatures along the preheating zone are controlled so that a coefficient of temperature rise in the recording substrate never exceeds 180° Kelvin per second.

30. The method according to claim 28 including the step of providing at least one temperature sensor in the preheating zone and controlling heater elements in the preheating zone based on a temperature measured at the temperature sensor.

31. The method according to claim 28 including the step of providing the preheating zone as first and second zones sequentially following each other prior to the fixing station, and wherein temperatures in the first zone are controlled independently of temperatures in the second zone so that the coefficient of temperature rise is not exceeded as the recording substrate moves through the first and second zones.

32. The method according to claim 28 wherein the preheating zone is divided into at least two laterally positioned zones running side-by-side along a running direction of the substrate, and selectively activating either the one zone or both of the zones depending on a width of the recording substrate so that a size of the preheating zone can be changed to accommodate different widths of the recording substrate.

33. A thermofixing device for fixing a toner image on a recording substrate, comprising:

a toner image fixing station for fixing the toner image to the recording medium by means of pressure and by heating the toner image to a melting temperature assigned to a melting range of a material of the toner image;

a preheating saddle arrangement upstream of the fixing station in a running direction of the recording substrate for preheating the recording substrate such that a coefficient of temperature rise, which defines a limiting value for a permissible temperature rise per unit time and which is dependent on a material of the recording substrate, is not exceeded as the recording substrate travels along the preheating saddle arrangement; and at least one temperature sensor in the preheating saddle arrangement connected to a controller for controlling power to heating elements spaced along the saddle arrangement so that the coefficient of temperature rise of the recording substrate is not exceeded.

34. The device according to claim 33 wherein the heating saddle arrangement is divided into a preheating saddle and a heating saddle which are separate from one another and wherein at least the first temperature sensor is provided in the preheating saddle and at least a second temperature sensor is provided in the heating saddle, and wherein first and second desired temperatures respectively for the preheating saddle and the heating saddle are independently set and maintained by use of the independent first and second temperature sensors and said controller.

35. The device according to claim 33 wherein said controller, by controlling temperatures in the preheating saddle and heating saddle, causes an approximately uniform thermal energy flow to occur to the recording substrate as the recording substrate moves along the preheating saddle and heating saddle.

36. The device according to claim 33 wherein heating elements in the preheating saddle are equally spaced from one another and from a surface of the preheating saddle, and wherein heating elements in the heating saddle are equally spaced from one another and from a surface of the heating saddle.

37. The thermal fixing device for fixing a toner image on a recording substrate, comprising:

a toner fixing station for fixing of the toner image on the recording substrate by means of pressure and by heating the toner image to a melting temperature assigned to a melting range of a material of the toner image;

a preheating saddle followed by a heating saddle upstream of the fixing station for guiding and preheating the recording substrate prior to entry into the fixing station;

a first temperature sensor in the preheating saddle and a second temperature sensor in the heating saddle; and a controller connected to the first and second heat sensors for maintaining a desired first temperature at the first sensor in the preheating saddle and for maintaining a desired second temperature at the second temperature sensor in the heating saddle independently of the first temperature set for the preheating saddle.

38. The device according to claim 37 wherein heating elements in the preheating saddle are equally spaced from one another and also from a surface of the preheating saddle, and heating elements in the heating saddle are equally spaced from one another and from a surface of the heating saddle.

39. The device according to claim 37 wherein in both the preheating saddle and the heating saddle, at least two laterally positioned heating zones are defined each running in a running direction of the recording substrate, and wherein said controller can activate either one or both of the zones to accommodate different widths of the recording substrate.

* * * * *